US011610747B1

(12) United States Patent
Li et al.

(10) Patent No.: US 11,610,747 B1
(45) Date of Patent: Mar. 21, 2023

(54) KEYBOARD

(71) Applicant: Chicony Electronics Co., Ltd., New Taipei (TW)

(72) Inventors: Ping-Chen Li, New Taipei (TW); Chao-Chin Hsieh, New Taipei (TW)

(73) Assignee: Chicony Electronics Co., Ltd., New Taipei (TW)

( * ) Notice: Subject to any disclaimer, the term of this patent is extended or adjusted under 35 U.S.C. 154(b) by 0 days.

(21) Appl. No.: 17/650,244

(22) Filed: Feb. 7, 2022

(30) Foreign Application Priority Data

Nov. 25, 2021 (TW) ..... 110144024

(51) Int. Cl.
*H01H 13/12* (2006.01)
*H01H 13/7065* (2006.01)
*H01H 13/83* (2006.01)

(52) U.S. Cl.
CPC ..... *H01H 13/7065* (2013.01); *H01H 13/83* (2013.01); *H01H 2219/002* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS

| | | | | |
|---|---|---|---|---|
| 9,299,515 | B2 * | 3/2016 | Chen | H01H 13/83 |
| 9,633,800 | B1 * | 4/2017 | Tsai | H01H 13/705 |
| 2014/0144764 | A1 | 5/2014 | Wilson et al. | |
| 2018/0025859 | A1 * | 1/2018 | Chen | H01H 13/7065 200/5 A |
| 2018/0158625 | A1 * | 6/2018 | Mahajan | H01H 3/125 |

FOREIGN PATENT DOCUMENTS

TW I657470 B 4/2019

* cited by examiner

*Primary Examiner* — Ahmed M Saeed
(74) *Attorney, Agent, or Firm* — CKC & Partners Co., LLC

(57) ABSTRACT

A keyboard includes a substrate, a display member, and a keyswitch assembly. The display member is disposed over the substrate. The keyswitch assembly includes a keycap, a fixing element, two balance bars, and a position-returning member. The keycap is located over the substrate and has a light-transmitting portion located over the display member. The fixing element is disposed on the substrate and has a retaining slot. Each of the balance bars includes a rod portion and an end portion. The rod portion is rotatably engaged with the keycap. The end portion is movably retained in the retaining slot. The position-returning member abuts against the keycap above the substrate and is adjacent to an edge of the keycap.

7 Claims, 9 Drawing Sheets

KEYBOARD

CROSS-REFERENCE TO RELATED APPLICATION

This application claims priority to Taiwan Application Serial Number 110144024, filed Nov. 25, 2021, which is herein incorporated by reference.

BACKGROUND

Technical Field

The present disclosure relates to a keyboard.

Description of Related Art

As far as the current usage habits of personal computers are concerned, the keyboard is one of the indispensable input devices for inputting characters or numbers. Not only that, for example, all consumer electronic products or large-scale processing equipment used in the industrial world that are used in daily life must be provided with keyswitches as input devices to operate the above-mentioned electronic products and processing equipment.

Generally speaking, ink printing, spray painting, laser engraving, etc. can be used to present specific characters on the surfaces of the keycaps of the keyboard. However, different kinds of language characters belong to different kinds of keyboards. Different kinds of keyboards will have different stockpiles, which makes it impossible to reduce production and marketing costs. In addition, the conventional keyboard cannot allow the user to replace the characters displayed on the surfaces of the keycaps with other desired patterns or characters as required.

Accordingly, how to provide a keyboard to solve the aforementioned problems becomes an important issue to be solved by those in the industry.

SUMMARY

An aspect of the disclosure is to provide a keyboard that can efficiently solve the aforementioned problems.

According to an embodiment of the disclosure, a keyboard includes a substrate, a display member, and a keyswitch assembly. The display member is disposed over the substrate. The keyswitch assembly includes a keycap, a fixing element, two balance bars, and a position-returning member. The keycap is located over the substrate and has a light-transmitting portion located over the display member. The fixing element is disposed on the substrate and has a retaining slot. Each of the balance bars includes a rod portion and an end portion. The rod portion is rotatably engaged with the keycap. The end portion is movably retained in the retaining slot. The position-returning member abuts against the keycap above the substrate and is adjacent to an edge of the keycap.

In an embodiment of the disclosure, the position-returning member is disposed under one of the balance bars. The position-returning member is elongated and extends substantially parallel to the rod portion of the one of the balance bars.

In an embodiment of the disclosure, the position-returning member has an accommodating groove. The accommodating groove accommodates a part of the rod portion of the one of the balance bars.

In an embodiment of the disclosure, the keyboard further includes a circuit board disposed on the substrate. The part of the rod portion abuts against a bottom of the accommodating groove. The position-returning member further has a conducting protrusion. The conducting protrusion is under the accommodating groove and configured to contact the circuit board when the keycap is pressed.

In an embodiment of the disclosure, the position-returning member further has two supporting legs. The supporting legs extend substantially parallel to the rod portion of the one of the balance bars.

In an embodiment of the disclosure, the position-returning member is disposed and contacted between the keycap and the fixing element.

In an embodiment of the disclosure, the balance bars includes a first balance bar and a second balance bar. The first balance bar is a solid structure. The end portion of the second balance bar is a hollow structure.

In an embodiment of the disclosure, at least a part of the end portion of the first balance bar is movably sleeved in the end portion of the second balance bar.

In an embodiment of the disclosure, the keyboard further includes a circuit board disposed on the substrate. The keycap has a conducting rib. The conducting rib is configured to contact the circuit board when the keycap is pressed.

In an embodiment of the disclosure, the display member is fixed to a bottom surface of the keycap.

In an embodiment of the disclosure, the keyboard further includes a holder. The holder has a first engaging structure. A bottom surface of the keycap has a second engaging structure. The first engaging structure and the second engaging structure are engaged with each other. The display member is carried on the holder.

Accordingly, in the keyboard of the present disclosure, the display member disposed over the substrate can display specific patterns or characters according to a user's needs, and can be viewed by the user through the light-transmitting portion of the keycap, so it is very convenient for the user to change the patterns or characters to highlight the uniqueness of the keyboard. The keyboard of the present disclosure utilizes two balance bars instead of the conventional scissors-like linkage structure to guide the movement of the keycap, so that the problem of blocking the display member can be effectively avoided. In addition, the end portions of the two balance bars can be designed to be sleeved with each other, so as to realize the interlocking movement of the two balance bars when the keycap is pressed. In some embodiments of the keyboard of the present disclosure, the position-returning member has an accommodating groove for accommodating a part of the balance bar, and has a conducting protrusion located under the accommodating groove. Therefore, when the keycap is pressed, the force-bearing distance of the conducting protrusion is short, so it has the effect of triggering the keyswitch signal faster.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
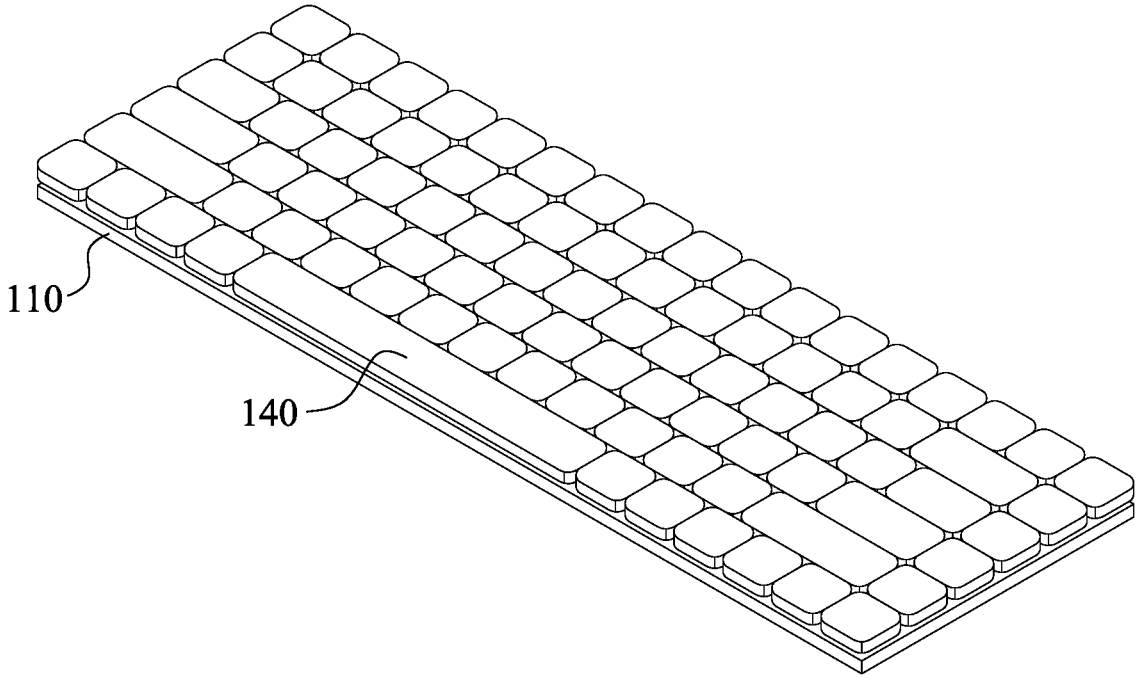
FIG. 1 is a perspective view of a keyboard according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts. However, specific structural and functional details disclosed herein are merely representative for purposes of describing example embodiments, and thus may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope of the disclosure.

Reference is made to FIG. 1. FIG. 1 is a perspective view of a keyboard 100 according to an embodiment of the present disclosure. As shown in FIG. 1, the keyboard 100 of the present disclosure may be an external keyboard (e.g., a keyboard with a PS/2 interface or a keyboard with a USB interface) used in a desktop computer, or may be a part of a computer system having an input device (e.g., a touch pad on a notebook computer) that is in the form of a keyswitch, but the disclosure is not limited in this regard. That is, concepts of the keyboard 100 of the present disclosure may be used in any electronic product that performs input function by pressing.

Figure 2:
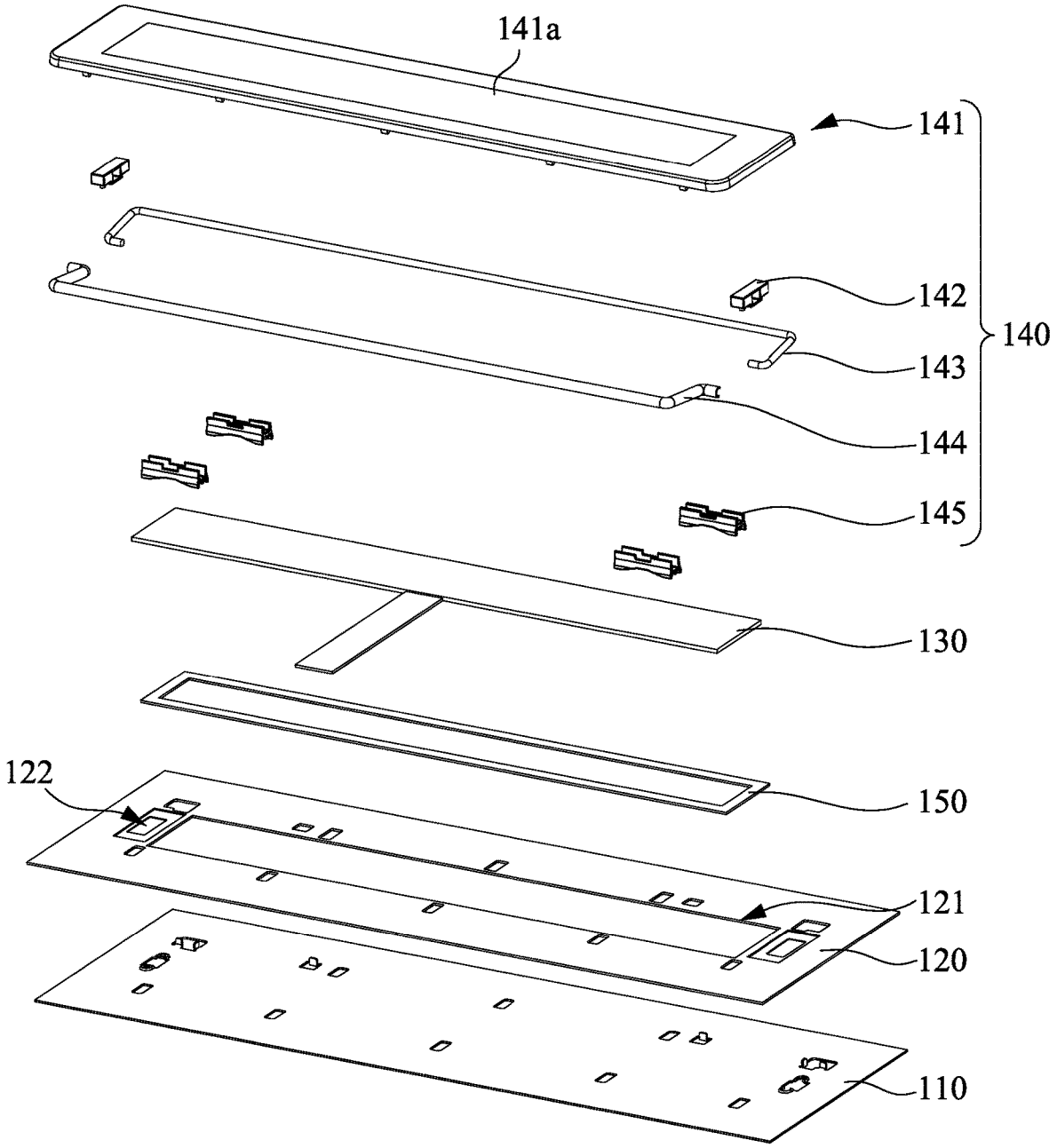
FIG. 2 is a partial exploded view of the keyboard according to an embodiment of the present disclosure.
Figure 3:
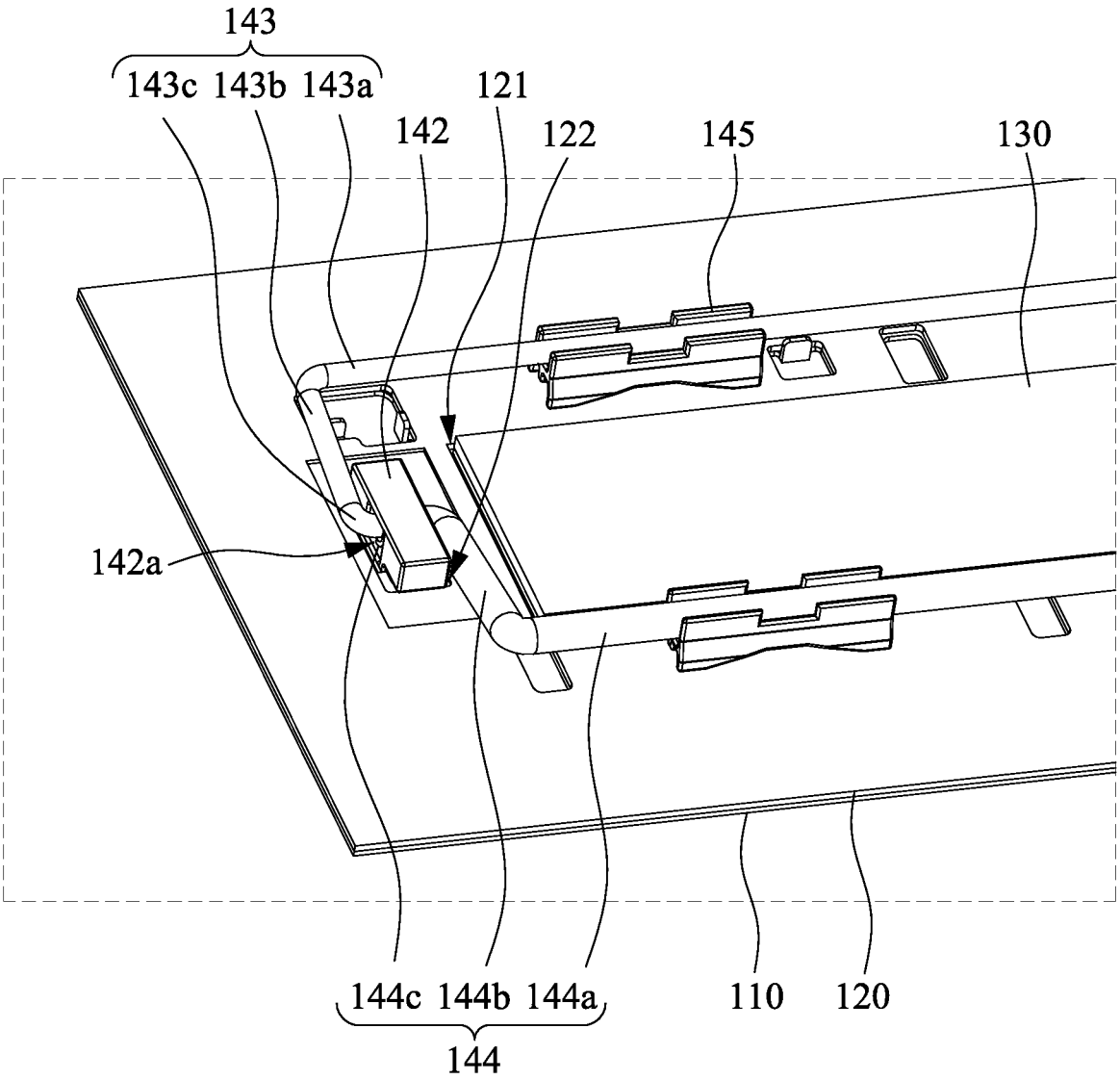
FIG. 3 is a partial perspective view of the structure in FIG. 2 omitting the keycap.

Reference is made to FIGS. 2 and 3. FIG. 2 is a partial exploded view of the keyboard 100 according to an embodiment of the present disclosure. FIG. 3 is a partial perspective view of the structure in FIG. 2 omitting a keycap 141. As shown in FIGS. 2 and 3, in the present embodiment, the keyboard 100 includes a substrate 110, a circuit board 120, and a plurality of keyswitch assemblies 140. The circuit board 120 is disposed on the substrate 110. The combination of the substrate 110, the circuit board 120, and a single keyswitch assembly 140 can be regarded as a keyswitch device. In the keyswitch device, the keyboard 100 further includes a display member 130. The display member 130 is disposed over the substrate 110.

As shown in FIGS. 2 and 3, the circuit board 120 has a hollow portion 121 therethrough. The display member 130 is disposed on the substrate 110 and disposed in the hollow portion 121, but the present disclosure is not limited in this regard. In other embodiments, the display member 130 may be disposed between the substrate 110 and the circuit board 120, and the circuit board 120 has a hollow or transparent area located directly over the display member 130.

Figure 4:
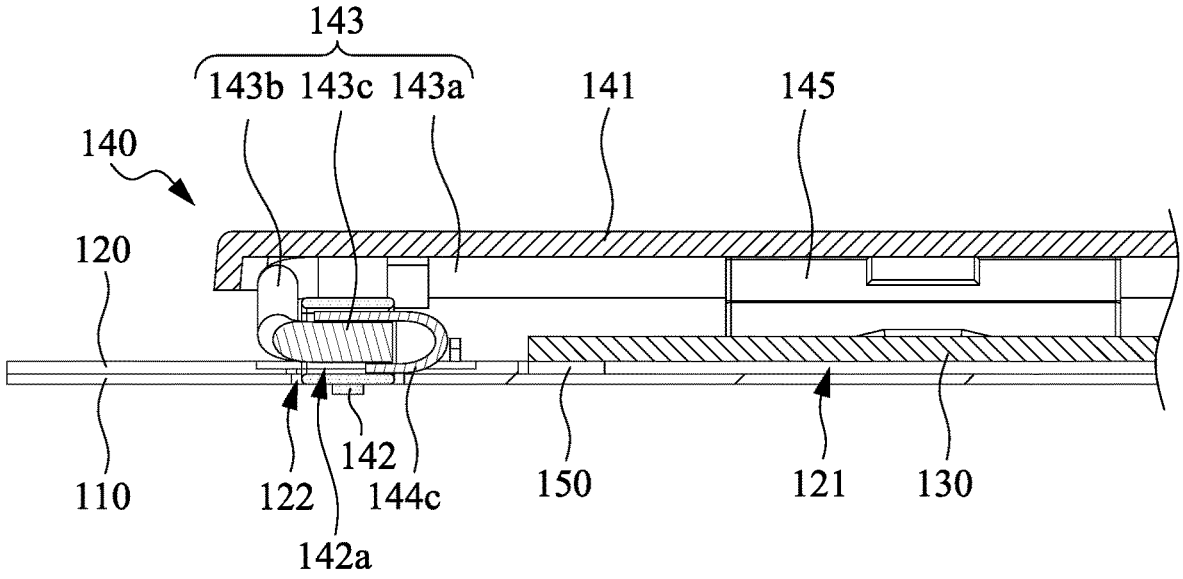
FIG. 4 is a partial cross-sectional view of the structure in FIG. 2.

As shown in FIGS. 2 and 4, in the present embodiment, the keyboard 100 further includes a pad 150. The display member 130 is disposed on the substrate 110 through the pad 150 to prevent short circuit. In this embodiment, the pad 150 is annular, but the present disclosure is not limited in this regard. In some embodiments, the material of the pad 150 includes insulating foam, but the present disclosure is not limited in this regard.

As shown in FIG. 2, in the present embodiment, the keyboard 100 further includes a keycap 141. The keycap 141 is located over the substrate 110 and has a light-transmitting portion 141*a* located over the display member 130. The display member 130 can display a specific pattern or text according to a user's needs, and can be viewed by the user through the light-transmitting portion 141*a* of the keycap 141, so it is very convenient for the user to change the pattern or text to highlight the uniqueness of the keyboard 100.

In some embodiments, the display member 130 is, for example, a liquid crystal display unit, a light-emitting diode display unit, an electronic paper display unit, etc., but the present disclosure is not limited in this regard.

As shown in FIGS. 2 and 3, in the present embodiment, the keyboard 100 further includes a fixing element 142, a first balance bar 143, and a second balance bar 144. The circuit board 120 has a through hole 122. The fixing element 142 is disposed on the substrate 110 through the through hole 122 and has a retaining slot 142*a*. The retaining slot 142*a* is a perforation in this embodiment, but the present disclosure is not limited in this regard. The first balance bar 143 includes a first rod portion 143*a*, a second rod portion 143*b*, and an end portion 143*c*. The first rod portion 143*a* is rotatably engaged with the keycap 141. The second rod portion 143*b* is connected to one end of the first rod portion 143*a*, is bent relative to the first rod portion 143*a*, and extends toward the fixing element 142. The end portion 143*c* is connected to one end of the second rod portion 143*b* and is bent relative to the second rod portion 143*b*. The second rod portion 143*b* is connected between the first rod portion 143*a* and the end portion 143*c*. In addition, the second balance bar 144 includes a first rod portion 144*a*, a second rod portion 144*b*, and an end portion 144*c*. The first rod portion 144*a* is rotatably engaged with the keycap 141. The second rod portion 144*b* is connected to one end of the first rod portion 144*a*, is bent relative to the first rod portion 144*a*, and extends toward the fixing element 142. The end portion 144*c* is connected to one end of the second rod portion 144*b* and is bent relative to the second rod portion 144*b*. The second rod portion 144*b* is connected between the first rod portion 144*a* and the end portion 144*c*. In this embodiment, a length of the first rod portion 143*a* of the first balance bar 143 is greater than a length of the first rod portion 144*a* of the second balance bar 144, so the second rod portion 143*b* of the first balance bar 143 is located outside the second rod portion 144*b* of the second balance bar 144. The end portion 143*c* of the first balance bar 143 extends toward the inside and the end portion 144*c* of the second balance bar 144 extends toward the outside, so that the end portion 143*c* of the first balance bar 143 and the end portion 144*c* of the second balance bar 144 are respectively inserted into the retaining slot 142*a* and movably retained in the retaining slot 142*a*. Through the aforementioned structural configurations to make the first balance bar 143 and the second balance bar 144 be movably disposed on the keycap 141 and the substrate 110, when the keycap 141 is pressed (especially when the user presses edges or corners of the keycap 141), the pressing force can be transmitted to the entire keycap 141 through the first balance bar 143 and the second balance bar 144 to drive the keycap 141 to move up and down relative to the substrate 110 stably.

With the aforementioned structural configurations, the first balance bar 143 and the second balance bar 144 can replace the conventional scissors-like linkage structure to guide the movement of the keycap 141, so the problem of blocking the display member 130 can be effectively avoided.

In some embodiments, the keycap 141 may be manufactured by a process such as double injection molding (for example, the periphery of the pressing surface of the keycap 141 is made of black material, and the center is made of transparent material), partial painting, or printing. In this way, the center of the pressing surface of the keycap 141 can allow the user to view the pattern or text displayed by the display member 130 below, and the periphery of the pressing surface of the keycap 141 can shield the first balance bar 143, the second balance bar 144, and the fixing element 142 below.

In some embodiments, a material of the fixing element 142 may include plastic, and may be fixed on the substrate 110 through a heat staking process, but the present disclosure is not limited in this regard.

Reference is made to FIG. 4. FIG. 4 is a partial cross-sectional view of the structure in FIG. 2. As shown in FIG. 4, in the present embodiment, the first balance bar 143 is a solid structure. The end portion 144*c* of the second balance bar 144 is a hollow structure. At least a part of the end portion 143*c* of the first balance bar 143 is movably sleeved in the end portion 144*c* of the second balance bar 144. By designing the end portion 143*c* of the first balance bar 143 and the end portion 144*c* of the second balance bar 144 to be a mutually sleeved structure configuration, the interlocking motion of the first balance bar 143 and the second balance bar 144 when the keycap 141 is pressed can be realized. In some embodiments, the end portion 143*c* of the first balance bar 143 and the end portion 144*c* of the second balance bar 144 may further be provided with corresponding bump and groove structures, so that the first balance bar 143 and the second balance bar 144 can be linked with each other.

In the present embodiment, the second balance bar 144 may be a hollow structure as a whole. In other embodiments, the first rod portion 144*a* and the second rod portion 144*b* of the second balance bar 144 may be solid structures, and the end portion 144*c* may be a hollow sleeve sleeved on the second rod portion 144*b*. However, the present disclosure is not limited in this regard.

In some embodiments, a material of at least one of the first balance bar 143 and the second balance bar 144 includes metal, but the present disclosure is not limited in this regard.

As shown in FIGS. 2 and 3, in the present embodiment, the keyswitch assembly 140 further includes a plurality of position-returning members 145. The position-returning members 145 are disposed on the circuit board 120, abut against the keycap 141, and are adjacent to edges of the keycap 141. Some of the position-returning members 145 are disposed under the first rod portion 143*a* of the first balance bar 143, and other position-returning members 145 are disposed under the first rod portion 144*a* of the second balance bar 144. When the keycap 141 receives an external force and is pressed down, the position-returning members 145 generate forces against the keycap 141, so as to provide the user with a pressing feel. In addition, through the guidance of the first balance bar 143 and the second balance bar 144, the pressed keycap 141 can be moved to its lowest position. After the external force applied to the keycap 141 is released, the position-returning members 145 can make the aforementioned pressed keycap 141 return to its highest position by the force generated. In some embodiments, the position-returning members 145 may be elastic bodies, and the material may include rubber, but the present disclosure is not limited in this regard.

Figure 5:
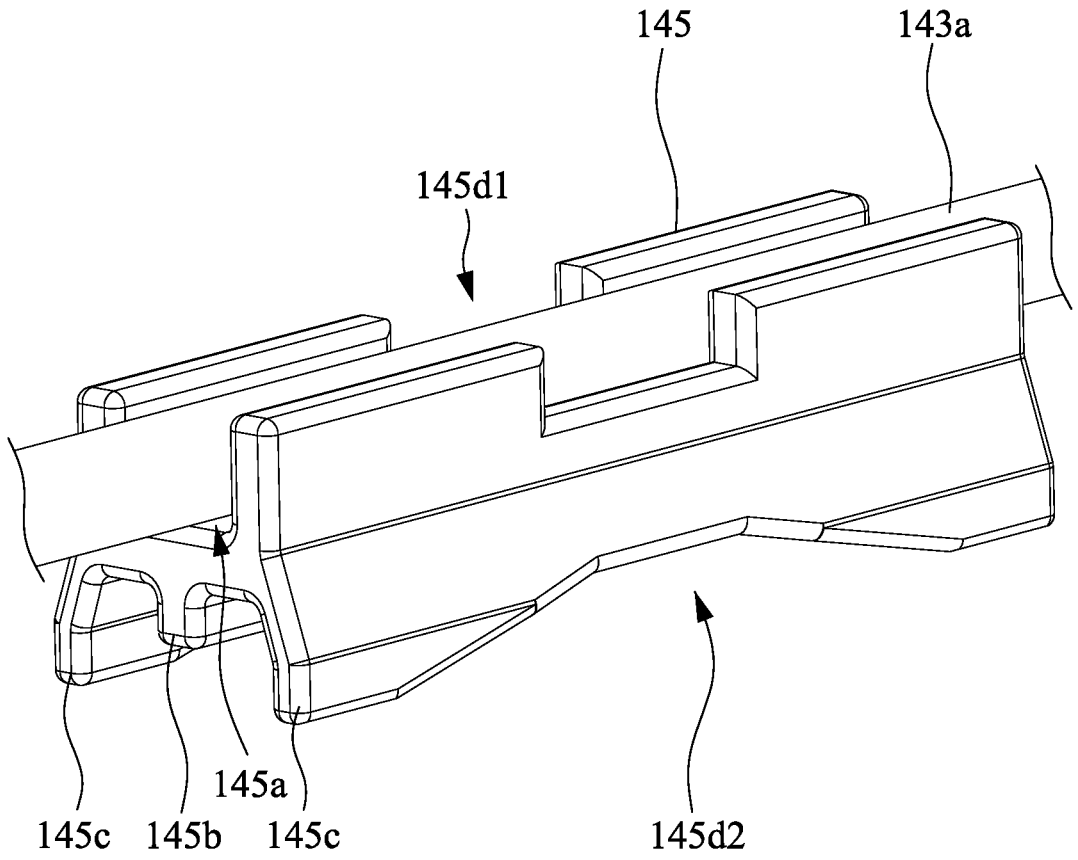
FIG. 5 is a partial perspective view of a first balance bar and a position-returning member in FIG. 3.

Reference is made to FIG. 5. FIG. 5 is a partial perspective view of the first balance bar 143 and the position-returning member 145 in FIG. 3. As shown in FIG. 5, in the present embodiment, the position-returning member 145 has an accommodating groove 145*a*. The accommodating groove 145*a* is recessed from a side of the position-returning member 145 facing the keycap 141 and corresponding to the first rod portion 143*a* of the first balance bar 143. The accommodating groove 145*a* accommodates a part of the first rod portion 143*a* of the first balance bar 143. The part of the first rod portion 143*a* abuts the bottom of the accommodating groove 145*a*. In addition, the position-returning member 145 further has a conducting protrusion 145*b*. The conducting protrusion 145*b* is located under the accommodating groove 145*a* and is configured to contact the circuit board 120 when the keycap 141 is pressed.

In some other embodiments, the circuit board 120 may be, for example, a membrane circuit board, but the disclosure is not limited in this regard. For example, the circuit board 120 includes a lower film layer, an upper film layer, and a spacer layer (not shown) separating the two film layers. The spacer layer has a through hole located directly under the keycap 141. The lower film layer and the upper film layer respectively include a circuit and a plurality of conductive contacts. When the keycap 141 is not pressed, the conductive contacts on the upper film layer and the circuit on the lower film layer are separated on both sides of the spacer layer and electrically separated. When the keycap 141 is pressed and moved toward the substrate 110, the keycap 141 will directly or indirectly push the upper film layer to partially enter the through hole of the spacer layer, so that the conductive contacts on the upper film layer pass through the through hole to contact the circuit of the lower film layer (that is, the trigger action). Hence, the circuit board 120 can then generate a trigger signal corresponding to the pressed keyswitch assembly 140.

With the structural configurations between the first rod portion 143*a* and the accommodating groove 145*a* of the position-returning member 145, when the keycap 141 is pressed, since the force-bearing distance of the conducting protrusion 145*b* is short, it has the effect of quickly triggering the keyswitch signal.

As shown in FIG. 5, in the present embodiment, the position-returning member 145 is elongated and extends substantially parallel to the first rod portion 143*a* of the first balance bar 143. In addition, the position-returning member 145 further has two supporting legs 145*c*. The supporting legs 145*c* extend substantially parallel to the first rod portion 143*a* of the first balance bar 143, and are respectively located on two sides of the conducting protrusion 145*b*. With the aforementioned structural configurations, the area where the single position-returning member 145 supports the keycap 141 can be increased, thereby effectively avoiding the problem of tilting when a certain edge or corner of the keycap 141 is pressed.

As shown in FIG. 5, in the present embodiment, the position-returning member 145 has a plurality of notches 145*d*1, 145*d*2. The notch 145*d*1 is formed on the side wall of the accommodating groove 145*a*, and is recessed from a side of the position-returning member 145 facing the keycap 141. The notches 145*d*2 are located on the supporting legs 145*c*, and are recessed from a side of the position-returning member 145 facing the substrate 110. Through the design of the notches 145*d*1, 145*d*2, the difficulty of the position-returning member 145 being deformed under pressure can be adjusted, so as to have the effect of providing a specific pressing feel according to requirements.

Figure 6:
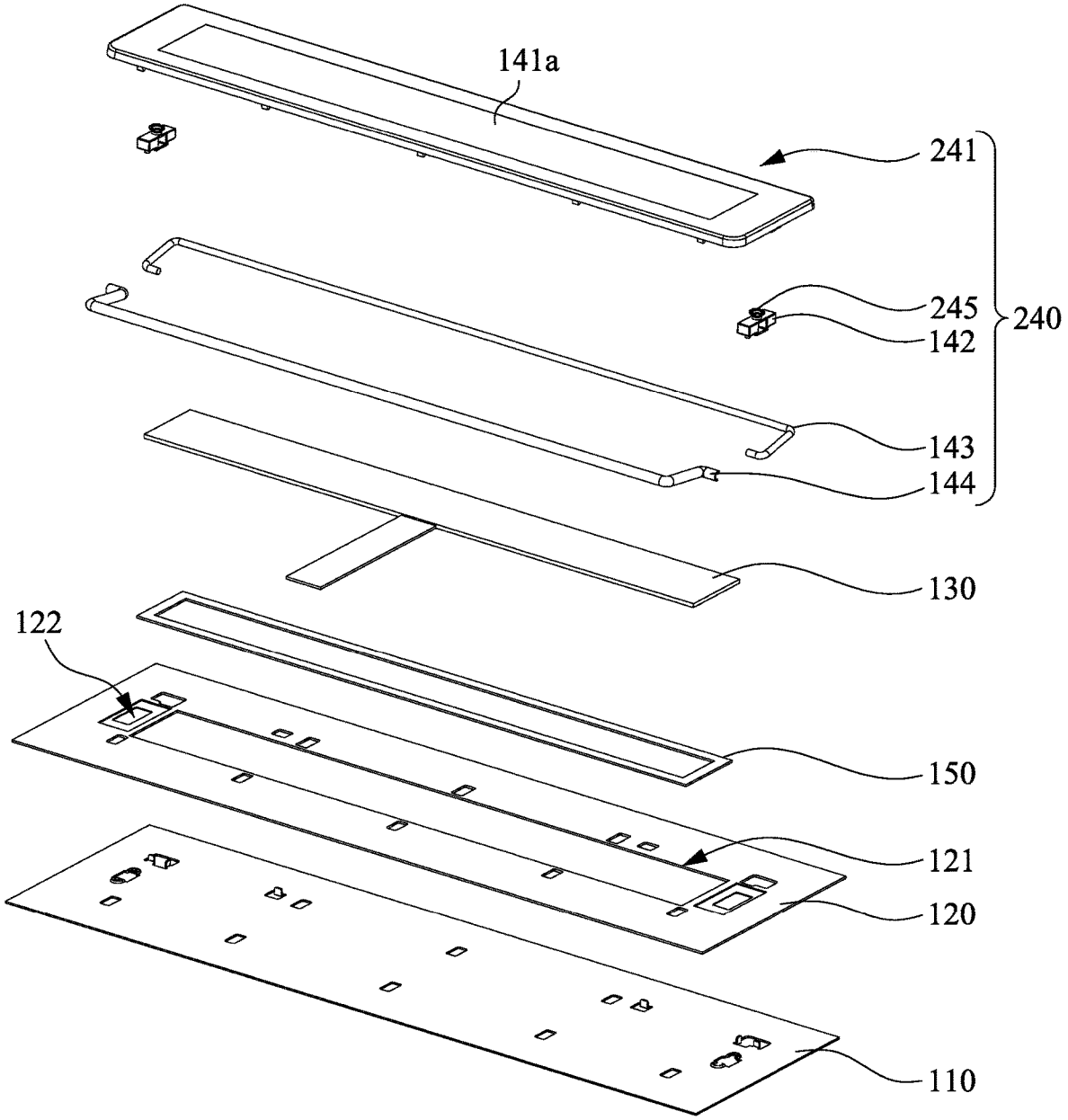
FIG. 6 is a partial exploded view of a keyboard according to another embodiment of the present disclosure.
Figure 7:
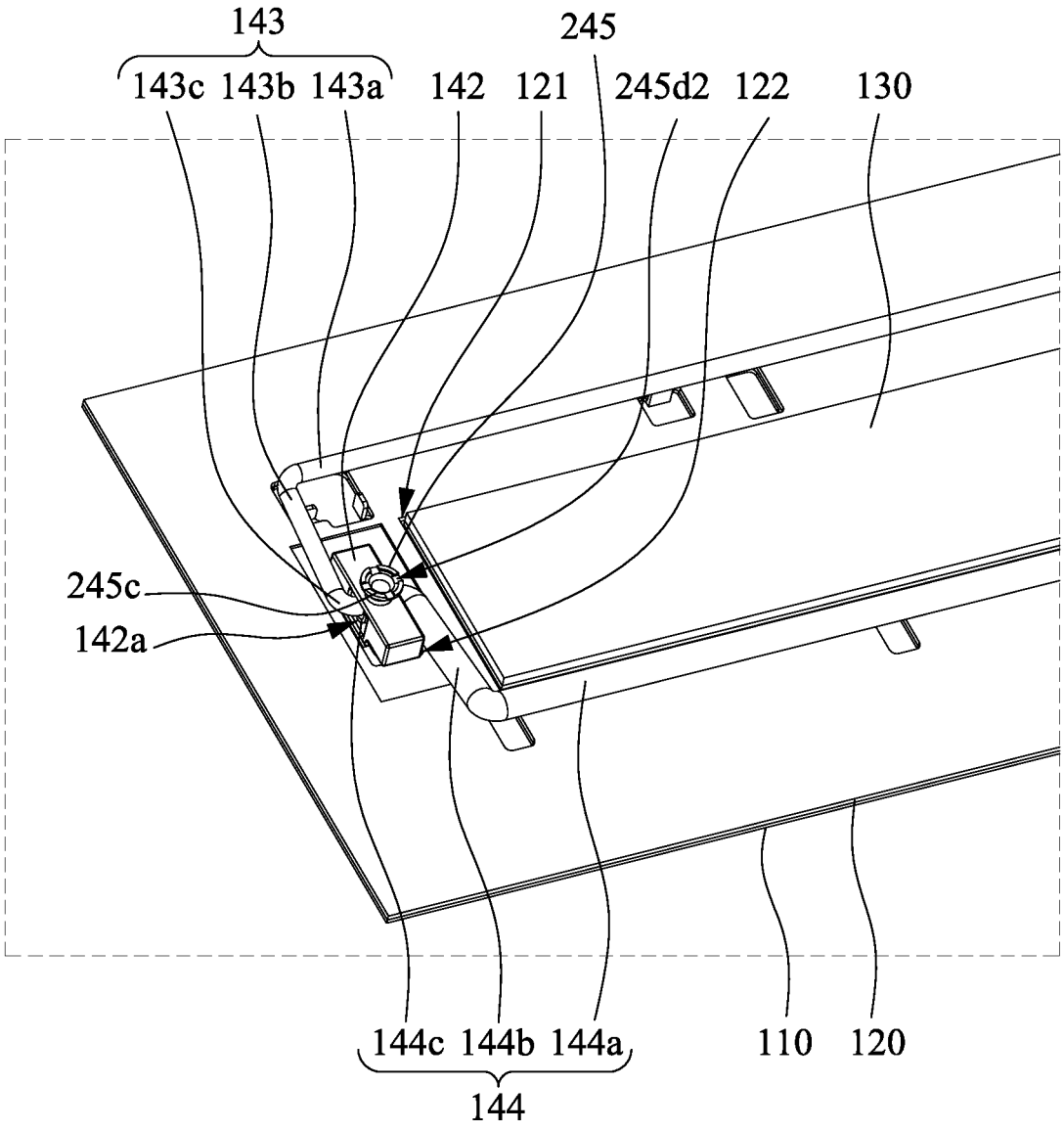
FIG. 7 is a partial perspective view of the structure in FIG. 6 omitting the keycap.
Figure 8:
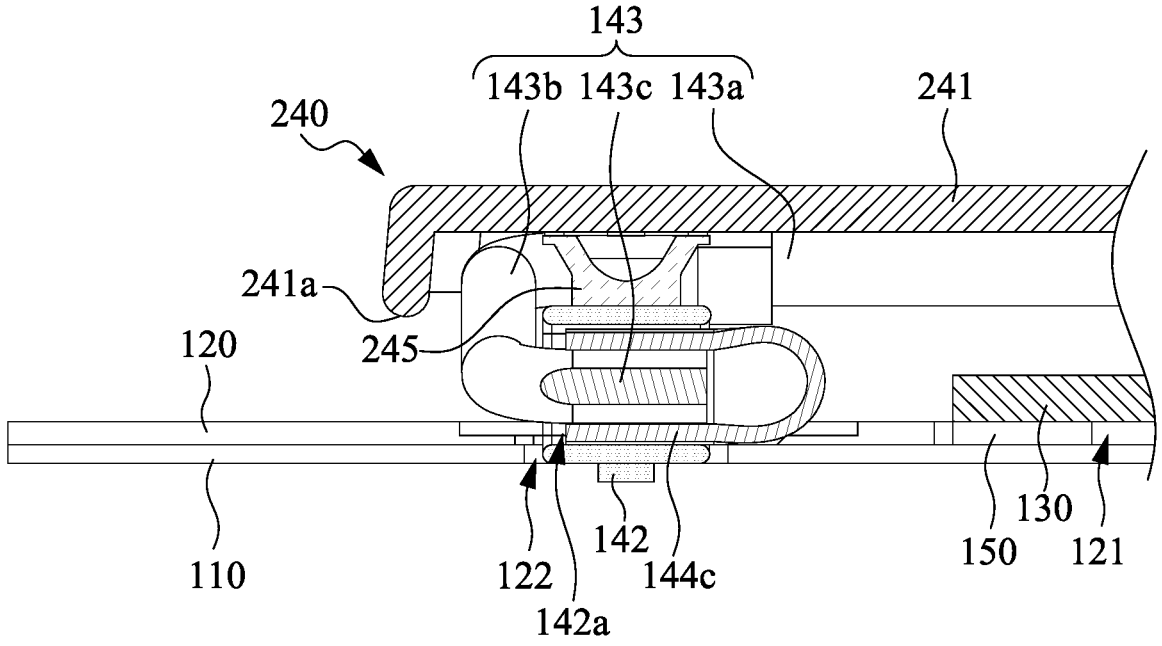
FIG. 8 is a partial cross-sectional view of the structure in FIG. 6.

Reference is made to FIGS. 6, 7, and 8. FIG. 6 is a partial exploded view of the keyboard 100 according to another embodiment of the present disclosure. FIG. 7 is a partial perspective view of the structure in FIG. 6 omitting a keycap 241. FIG. 8 is a partial cross-sectional view of the structure in FIG. 6. As shown in FIGS. 6 to 8, in the present embodiment, the keyboard 100 includes a substrate 110, a circuit board 120, a display member 130, a plurality of keyswitch assemblies 240, and a pad 150, in which the substrate 110, the circuit board 120, the display member 130, and the pad 150 are the same or similar to those in the embodiment shown in FIG. 2, so the description of these components can refer to the above-mentioned related descriptions and will not be repeated here. Further, the keyswitch assembly 240 of the embodiment includes a keycap 241, a fixing element 142, a first balance bar 143, a second balance bar 144, and a position-returning member 245, in which the fixing element 142, the first balance bar 143, and the second balance bar 144 are the same or similar to those in the embodiment shown in FIG. 2, so the description of these components can refer to the above-mentioned related descriptions and will not be repeated here.

It should be noted that a difference between the present embodiment and the embodiment shown in FIG. 2 is that the position-returning member 245 of the present embodiment is disposed and contacted between the keycap 141 and the fixing element 142. When the keycap 241 receives the external force and is pressed down, the position-returning member 245 generates a force to support the keycap 241, thereby providing the user with a pressing feeling. In addition, through the guidance of the first balance bar 143 and the second balance bar 144, the pressed keycap 241 can be moved to its lowest position. After the external force applied to the keycap 241 is released, the position-returning member 245 can make the pressed keycap 241 return to its highest position by the generated force. In the present embodiment, the position-returning member 245 is an inverted dome structure. A diameter of a surface of the position-returning member 245 facing the keycap 241 is larger than a diameter of a surface of the position-returning member 245 facing the substrate 110, and the position-returning member 245 is provided with a plurality of arc-shaped supporting legs 245*c*. The supporting legs 245*c* abut against the bottom surface of the keycap 241. The notches 245*d*2 among the supporting legs 245*c* can be used to adjust the difficulty of the position-returning member 245 being deformed under pressure, so as to provide a specific pressing feel according to requirements. In addition, when the position-returning member 245 is compressed, the air can be discharged through the notches 245*d*2.

In some embodiments, the position-returning member 245 may be disposed on the fixing element 142 by a process of injection molding. In other embodiments, the position-returning member 245 may be attached to the fixing element 142 by an adhesive process (e.g., through glue). In other embodiments, the position-returning member 245 may be disposed on the bottom surface of the keycap 241 in the aforementioned manner.

As shown in FIG. 8, in the present embodiment, the keycap 241 has a conducting rib 241*a*. The conducting rib 241*a* is disposed on an edge of the keycap 241 and protrudes toward the substrate 110. The conducting rib 241*a* is configured to contact the circuit board 120 when the keycap 241 is pressed. As mentioned above, in the embodiment where the circuit board 120 is a membrane circuit board including a lower film layer, an upper film layer, and a spacer layer, when the keycap 241 is pressed and moved toward the substrate 110, the keycap 241 will press to deform the position-returning member 245, so that the conducting rib 241*a* on the edge of the keycap 241 pushes the upper film layer to partially enter the through hole of the spacer layer, and thus the conductive contacts on the upper film layer pass through the through hole to contact the circuit of the lower film layer (that is, the trigger action). Hence, the circuit board 120 can then generate a trigger signal corresponding to the pressed keyswitch assembly 240.

Figure 9:
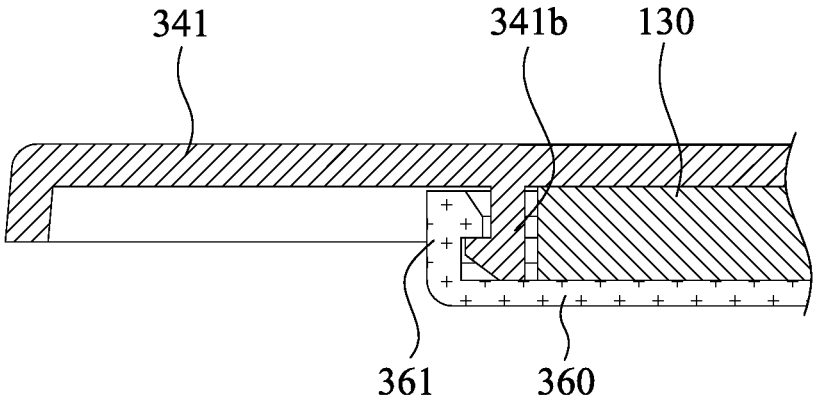
FIG. 9 is a partial cross-sectional view of some components of a keyswitch device according to another embodiment of the present disclosure.

Reference is made to FIG. 9. FIG. 9 is a partial cross-sectional view of some components of a keyswitch device according to another embodiment of the present disclosure. The present embodiment modifies the structure of the keycap 141 in the embodiment shown in FIG. 2 and the keycap 241 in the embodiment shown in FIG. 6, and also modifies the position of the display member 130. Specifically, in the present embodiment, the keyswitch device further includes a holder 360. The holder 360 has a first engaging structure 361. A bottom surface of the keycap 341 has a second engaging structure 341*b*. The first engaging structure 361 and the second engaging structure 341*b* are engaged with each other. The display member 130 is carried on the holder 360 and is located between the holder 360 and the bottom surface of the keycap 341. It can be seen that, in practical applications, the design of disposing the display member 130 on the substrate 110 in the embodiment shown in FIGS. 2 and 6 can be modified to be fixed to the bottom surface of the keycap 341 according to the present embodiment. In this way, the display member 130 can move up and down together with the pressed keycap 341. In some embodiments, the shapes of the first engaging structure 361 and the second engaging structure 341*b* are hooks, but the present disclosure is not limited in this regard.

According to the foregoing recitations of the embodiments of the disclosure, it can be seen that in the keyboard of the present disclosure, the display member disposed over the substrate can display specific patterns or characters according to a user's needs, and can be viewed by the user through the light-transmitting portion of the keycap, so it is very convenient for the user to change the patterns or characters to highlight the uniqueness of the keyboard. The keyboard of the present disclosure utilizes two balance bars instead of the conventional scissors-like linkage structure to guide the movement of the keycap, so that the problem of blocking the display member can be effectively avoided. In addition, the end portions of the two balance bars can be designed to be sleeved with each other, so as to realize the interlocking movement of the two balance bars when the keycap is pressed. In some embodiments of the keyboard of the present disclosure, the position-returning member has an accommodating groove for accommodating a part of the balance bar, and has a conducting protrusion located under the accommodating groove. Therefore, when the keycap is pressed, the force-bearing distance of the conducting protrusion is short, so it has the effect of triggering the keyswitch signal faster.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A keyboard, comprising:

a substrate;

a display member disposed over the substrate; and a keyswitch assembly comprising:

a keycap located over the substrate and having a light-transmitting portion located over the display member;

a fixing element disposed on the substrate and having a retaining slot;

two balance bars, each of the balance bars comprising a rod portion and an end portion, the rod portion being rotatably engaged with the keycap, the end portion being movably retained in the retaining slot; and a position-returning member abutting against the keycap above the substrate and being adjacent to an edge of the keycap, wherein the position-returning member is disposed under one of the balance bars, wherein the position-returning member is elongated and extends substantially parallel to the rod portion of the one of the balance bars, wherein the position-returning member has an accommodating groove, and the accommodating groove accommodates a part of the rod portion of the one of the balance bars.

2. The keyboard of claim 1, further comprising a circuit board disposed on the substrate, the part of the rod portion abutting against a bottom of the accommodating groove, wherein the position-returning member further has a conducting protrusion, and the conducting protrusion is under the accommodating groove and configured to contact the circuit board when the keycap is pressed.

3. The keyboard of claim 1, wherein the position-returning member further has two supporting legs, and the supporting legs extend substantially parallel to the rod portion of the one of the balance bars.

4. The keyboard of claim 1, further comprising a circuit board disposed on the substrate, wherein the keycap has a conducting rib, and the conducting rib is configured to contact the circuit board when the keycap is pressed.

5. A keyboard, comprising:

a substrate;

a display member disposed over the substrate; and a keyswitch assembly comprising:

a keycap located over the substrate and having a light-transmitting portion located over the display member;

a fixing element disposed on the substrate and having a retaining slot;

two balance bars, each of the balance bars comprising a rod portion and an end portion, the rod portion being rotatably engaged with the keycap, the end portion being movably retained in the retaining slot; and a position-returning member abutting against the keycap above the substrate and being adjacent to an edge of the keycap, wherein the position-returning member is disposed between the keycap and the fixing element and in contact with the keycap and the fixing element.

6. A keyboard, comprising:

a substrate;

a display member disposed over the substrate; and a keyswitch assembly comprising:

a keycap located over the substrate and having a light-transmitting portion located over the display member;

a fixing element disposed on the substrate and having a retaining slot;

two balance bars, each of the balance bars comprising a rod portion and an end portion, the rod portion being rotatably engaged with the keycap, the end portion being movably retained in the retaining slot, wherein the balance bars comprises a first balance bar and a second balance bar, the first balance bar is a solid structure, and the end portion of the second balance bar is a hollow structure, and wherein at least a part of the end portion of the first balance bar is movably sleeved in the end portion of the second balance bar; and a position-returning member abutting against the keycap above the substrate and being adjacent to an edge of the keycap.

7. A keyboard, comprising:

a substrate;

a display member disposed over the substrate; and a keyswitch assembly comprising:

a keycap located over the substrate and having a light-transmitting portion located over the display member, wherein the display member is fixed to a bottom surface of the keycap;

a fixing element disposed on the substrate and having a retaining slot;

two balance bars, each of the balance bars comprising a rod portion and an end portion, the rod portion being rotatably engaged with the keycap, the end portion being movably retained in the retaining slot; and a position-returning member abutting against the keycap above the substrate and being adjacent to an edge of the keycap, wherein the keyboard further comprises a holder, the holder has a first engaging structure, a bottom surface of the keycap has a second engaging structure, the first engaging structure and the second engaging structure are engaged with each other, and the display member is carried on the holder.

* * * * *